US007163001B2

(12) United States Patent
Jung et al.

(10) Patent No.: US 7,163,001 B2
(45) Date of Patent: Jan. 16, 2007

(54) METHOD AND DEVICE FOR CONTROLLING THE VOLUMETRIC FLOW IN A FUEL INJECTION SYSTEM OF AN INTERNAL COMBUSTION ENGINE

(75) Inventors: Uwe Jung, Wörth an der Donau (DE); Diego Valero-Bertrand, Regensburg (DE); Michael Wirkowski, Regensburg (DE)

(73) Assignee: Siemens AG, Munich (DE)

( * ) Notice: Subject to any disclaimer, the term of this patent is extended or adjusted under 35 U.S.C. 154(b) by 67 days.

(21) Appl. No.: 11/063,175

(22) Filed: Feb. 22, 2005

(65) Prior Publication Data

US 2005/0188957 A1 Sep. 1, 2005

(30) Foreign Application Priority Data

Feb. 27, 2004 (DE) ..... 10 2004 009 616

(51) Int. Cl.
*F02M 59/36* (2006.01)
*F02M 59/20* (2006.01)

(52) U.S. Cl. ..... 123/458; 123/446

(58) Field of Classification Search ..... 123/458, 123/456, 447, 446, 357
See application file for complete search history.

(56) References Cited

U.S. PATENT DOCUMENTS 6,035,829 A 3/2000 Hartke et al.
6,196,191 B1 * 3/2001 Rembold et al. ..... 123/447
2004/0200456 A1 * 10/2004 Eser et al. ..... 123/458

FOREIGN PATENT DOCUMENTS

DE 198 38 812 C1 4/2000
DE 199 46 506 C1 7/2001
DE 10155249 C1 * 4/2003

* cited by examiner

*Primary Examiner*—Mahmoud Gimie
(74) *Attorney, Agent, or Firm*—Laurence A. Greenberg; Werner H. Stemer; Ralph E. Locher

(57) ABSTRACT

A method and device control a volumetric flow in a common rail injection system of an internal combustion engine by producing a rail pressure with a high pressure pump, setting the rail pressure with a high pressure control valve and determining the volumetric flow by a valve position of a volumetric flow control valve controlled by a precontrol characteristic field and a two-dimensional adaptation characteristic field having adaptation values for the valve position predefined as a function of two operating parameters of the engine. This overcomes the problem in current common rail injection systems of the adapted valve position of the volumetric flow control valve often being subject to error, for instance because the valve position is controlled as a function of the rail pressure only using a one-dimensional adaptation characteristic field. This can lead to unwanted ambiguities, which can result in injecting fuel in incorrect quantities.

10 Claims, 4 Drawing Sheets

METHOD AND DEVICE FOR CONTROLLING THE VOLUMETRIC FLOW IN A FUEL INJECTION SYSTEM OF AN INTERNAL COMBUSTION ENGINE

BACKGROUND OF THE INVENTION

Field of the Invention

The invention relates to a method and a device for controlling a volumetric flow in a common rail injection system in an internal combustion engine.

It is already known that in injection systems, in which the fuel is injected directly into a cylinder of an internal combustion engine, the rail pressure is regulated by a control system in the high pressure area using a pressure control valve. However, a load-point-dependent volumetric flow is controlled by a volumetric flow control valve. Control is thereby configured in such a way that the high pressure pump only supplies a current fuel requirement where possible. That mode of operation is intended on one hand to keep power consumption of the high pressure pump low. On the other hand, it also minimizes the quantity of fuel returned and the quantity of heat introduced into the low pressure area as a result.

In order to control the volumetric flow valve, a two-dimensional precontrol characteristic field is used, which is derived from the mass of fuel and the engine speed. In that precontrol characteristic field, the mass of fuel and engine speed represent a measure of the current volumetric flow requirement, which corresponds to a specific load for the internal combustion engine. Due to component scatter, it is also necessary to provide a characteristic field with adaptation values for control of the volumetric flow control valve. It is necessary, in particular, since the volumetric flow requirement can increase due to higher internal leakage levels due to wear over the life of the system. The adaptation characteristic field used to date is only a function of rail pressure. Thus the one-dimensional adaptation characteristic field is used in addition to the precontrol characteristic field to control the volumetric flow control valve.

If the precontrol characteristic field supplies values that are too low (e.g. because of a higher volumetric flow requirement due to wear), the response of the rail pressure regulator (high positive control deviation, since the quantity is not sufficient to maintain the pressure) triggers an adaptation of the volumetric flow control valve activation value, until the quantity is sufficient once again.

That adaptation value has to date been stored as a function of rail pressure and used at every load point operated at that pressure. The volumetric flow control valve is thus always controlled with the precontrol value plus the adaptation value.

However, assignment of the load point and rail pressure is not unique. One and the same pressure is used at different load points. That can mean that the adaptation value is used without reason at a load point, because at that load point the rail pressure is the same as at a different load point, at which adaptation took place.

The result is, for example, that instead of the correct adaptation value, an incorrect adaptation value, which is too high, is read from the characteristic curve and too much fuel is therefore supplied. Pressure-dependent control thus results in the wrong quantity of fuel being provided in the above-mentioned situations.

SUMMARY OF THE INVENTION

It is accordingly an object of the invention to provide a method and a device for controlling the volumetric flow in a fuel injection system of an internal combustion engine, which overcome the hereinafore-mentioned disadvantages of the heretofore-known methods and devices of this general type and which improve control of a volumetric flow control valve, in such a way that only a required quantity of fuel is supplied where possible.

With the foregoing and other objects in view there is provided, in accordance with the invention, a method for controlling a volumetric flow in a common rail injection system of an internal combustion engine. The method comprises producing a rail pressure with a high pressure pump, setting the rail pressure in the rail with a regulatable high pressure control valve and determining the volumetric flow by a valve position of a controllable volumetric flow control valve controlled by a precontrol characteristic field and a two-dimensional adaptation characteristic field having adaptation values for the valve position being predefined as a function of two operating parameters of the internal combustion engine.

The method and the device according to the invention for controlling the load-point-dependent volumetric flow in a fuel injection system in an internal combustion engine, have the advantage of using a two-dimensional adaptation characteristic field in addition to the precontrol characteristic field to determine the valve position of the volumetric flow control valve. It is thereby deemed particularly advantageous that with the two-dimensional adaptation characteristic field, the adaptation values for the volumetric flow adaptation valve are predefined as a function of two operating parameters of the internal combustion engine.

In accordance with another mode of the invention, in the adaptation characteristic field the adaptation values for the valve position can be created as a function of two of the following four operating parameters: mass of fuel, engine torque, engine speed and load. These possible combinations of two operating parameters advantageously result in adaptation values which are adjusted to the respective load point.

In accordance with a further mode of the invention, the adaptation values are stored in an adaptation characteristic field, which yields the adaptation values as a function of the two operating parameters engine speed and mass of fuel. These two operating parameters allow a unique adaptation value to be predefined for the volumetric flow control valve.

In accordance with an added mode of the invention, the same operating parameters are used for the axes of both of the characteristic fields, that is the precontrol characteristic field as well as the adaptation characteristic field. This mode of operation simplifies control of the volumetric flow control valve, since the two operating parameters are already used for the precontrol characteristic field and the load points therefore correspond.

In accordance with an additional mode of the invention, provision is made for interpolation between two stored adjacent values in the adaptation characteristic field, since the stored values do not correspond to the current load point in every instance in the adaptation characteristic field.

In accordance with yet another mode of the invention, a linear interpolation of the adaptation values is implemented, for which the known algorithms can be used.

In accordance with a concomitant mode of the invention, values of the adaptation characteristic field are adjusted during operation of the injection system. The values of the adaptation characteristic field are preferably modified, if the control variable of the regulator of the pressure control valve is above or below a defined threshold.

With the objects of the invention in view, there is also provided a device for controlling a load-point-dependent volumetric flow in a common rail injection system of an internal combustion engine. The device comprises a high pressure pump, a regulatable high pressure control valve, a controllable volumetric flow control valve, a storage unit for storing a two-dimensional adaptation characteristic field for the volumetric flow control valve and a programmable control unit. The programmable control unit controls a valve position of the volumetric flow control valve as a function of a precontrol characteristic field and the adaptation characteristic field as a function of two operating parameters of the internal combustion engine.

The device can advantageously be used in a diesel, gasoline or gas engine.

Other features which are considered as characteristic for the invention are set forth in the appended claims.

Although the invention is illustrated and described herein as embodied in a method and a device for controlling the volumetric flow in a fuel injection system of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
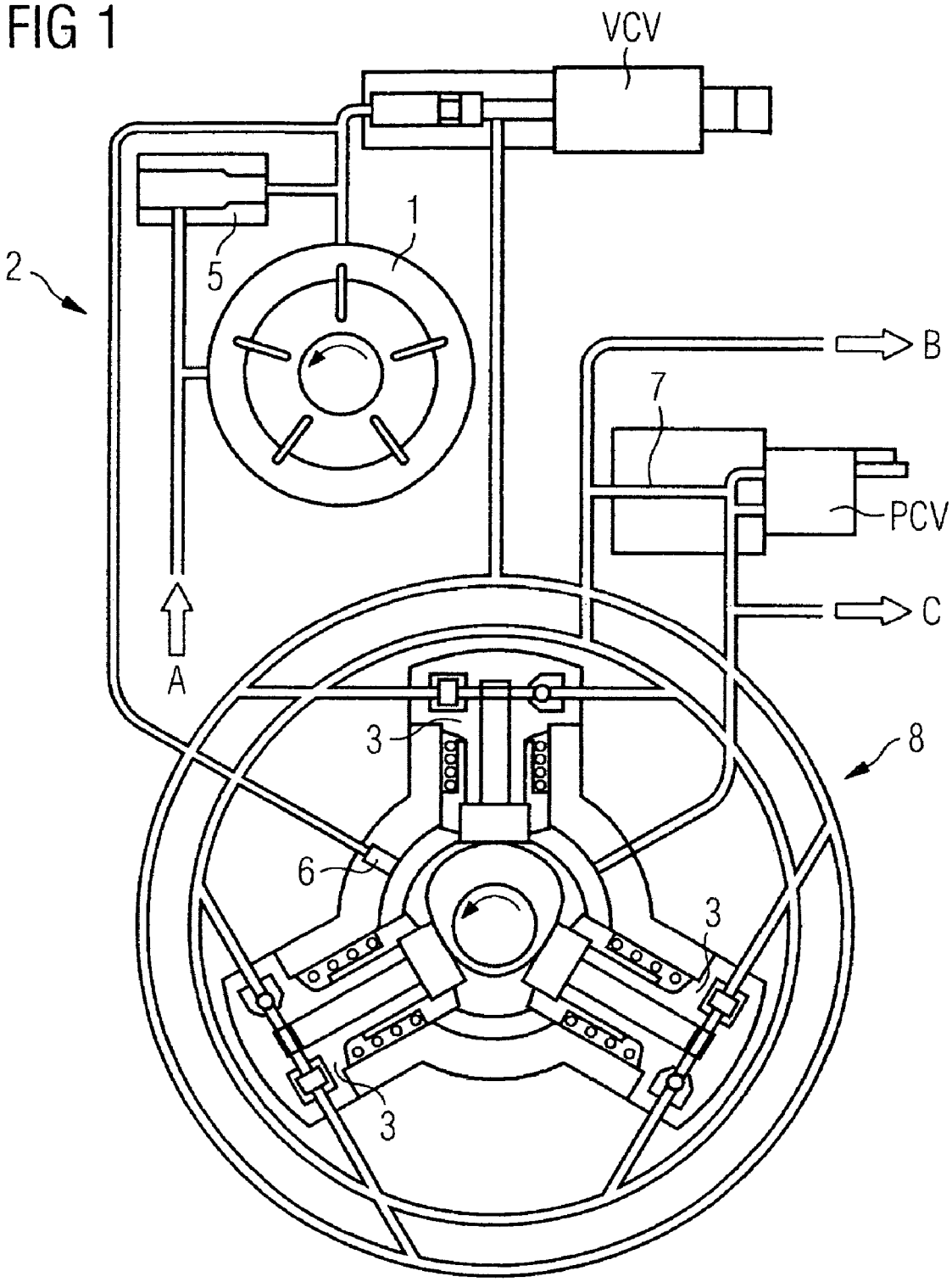
FIG. 1 is a diagrammatic plan view of a high pressure section of a common rail injection system.

Referring now to the figures of the drawings in detail and first, particularly, to FIG. 1 thereof, there is basically seen a diagrammatic representation of a high pressure section of a common rail injection system, which can be used for an internal combustion engine, for example a diesel, gasoline or gas engine. The figure shows components, with which fuel is supplied for injectors at high pressure in the rail.

The fuel is first supplied from a tank (which is not shown in FIG. 1) through a fuel supply line A to a fuel pre-delivery pump 1. The fuel pre-delivery pump 1 is connected through its output to an input of a controllable volumetric flow control valve (Volume Control Valve) VCV. In order to regulate delivery pressure, a delivery pressure control valve 5 is connected parallel to the fuel delivery pump, through which excess fuel can be delivered back to a low pressure area. An output of the volumetric flow control valve VCV is also connected to a high pressure pump 8, which produces a very high fuel pressure in the rail, depending on the application, for example 800 to 2000 bar. The high pressure pump 8, for example, has three displacement units 3 to produce the high rail pressure. A purge/lubrication valve 6 is also incorporated in a supply area of the high pressure pump 8, through the use of which the fuel pre-delivery pump 1 purges and lubricates the high pressure pump 8 with fuel.

A high pressure control valve (Pressure Control Valve) PCV is disposed at a high pressure output of the high pressure pump 8. The high pressure control valve PCV preferably uses a PI controller to regulate the high fuel pressure in the rail. A plate-type filter 7 is connected downstream of the high pressure control valve PCV at its output to filter solid suspended particles out of the fuel, before the fuel is supplied through a high pressure connection B to a downstream fuel tank with injectors connected thereto. A branch for a fuel return C, for feeding excess fuel back into the low pressure area, is disposed upstream of the input of the high pressure control valve PCV.

Figure 2:
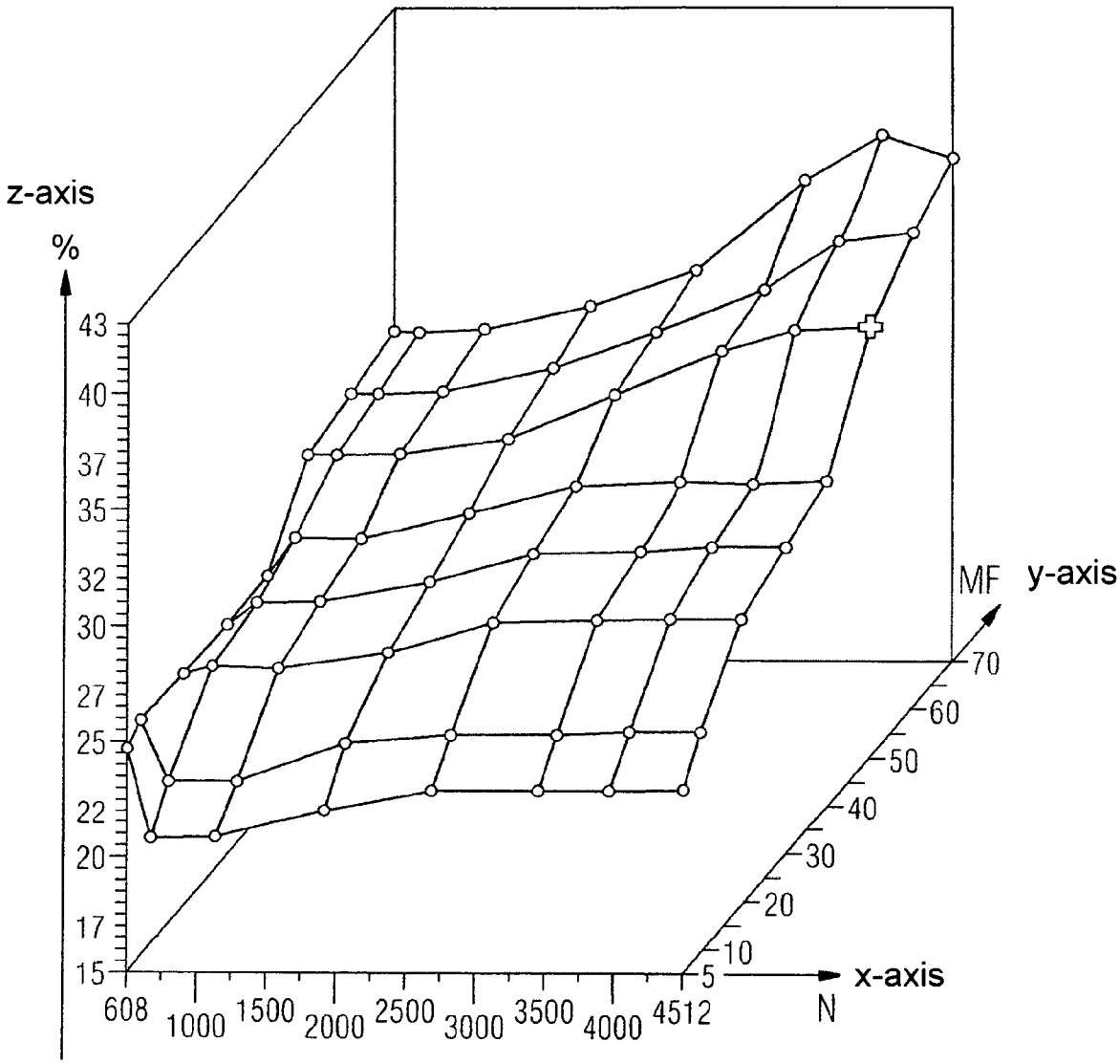
FIG 2 Prior Art
FIG. 2 is a graph of a two-dimensional precontrol characteristic field according to the prior art.

FIG. 2 shows a known two-dimensional precontrol characteristic field used to control the volumetric flow control valve VCV.

In the diagram of the precontrol characteristic field according to FIG. 2, an engine speed N is shown on the x-axis and a mass of fuel MF on the y-axis. A precontrol characteristic value for the volumetric flow control valve VCV can then be read for a current speed N and a load-dependent predefined mass of fuel MF on the z-axis as a percentage value (% value) of a pulse-width modulated signal, with which the volumetric flow control valve is activated. The precontrol characteristic value first serves as a preset value for the volumetric flow control valve VCV, which can still be adjusted using an adaptation value, to obtain a precise valve position as a function of actual parameters of the injection system.

Alternatively, the precontrol characteristic value can also be stored as a table. The table would also show the characteristic values as percentage values of the maximum angle of opening of the volumetric flow control valve VCV as a function of engine speed N and mass of fuel MF.

A valve position of the volumetric flow control valve VCV is controlled through the use of pulse width modulation (PWM) values. In order to be able to adapt the valve position, an adaptation value from the adaptation characteristic field is added to the precontrol characteristic value of the precontrol characteristic field to determine the PWM value for a current operating point.

According to the invention, it is proposed that the adaptation characteristic field be configured in a two-dimensional manner as a function of two operating parameters.

Figure 3:
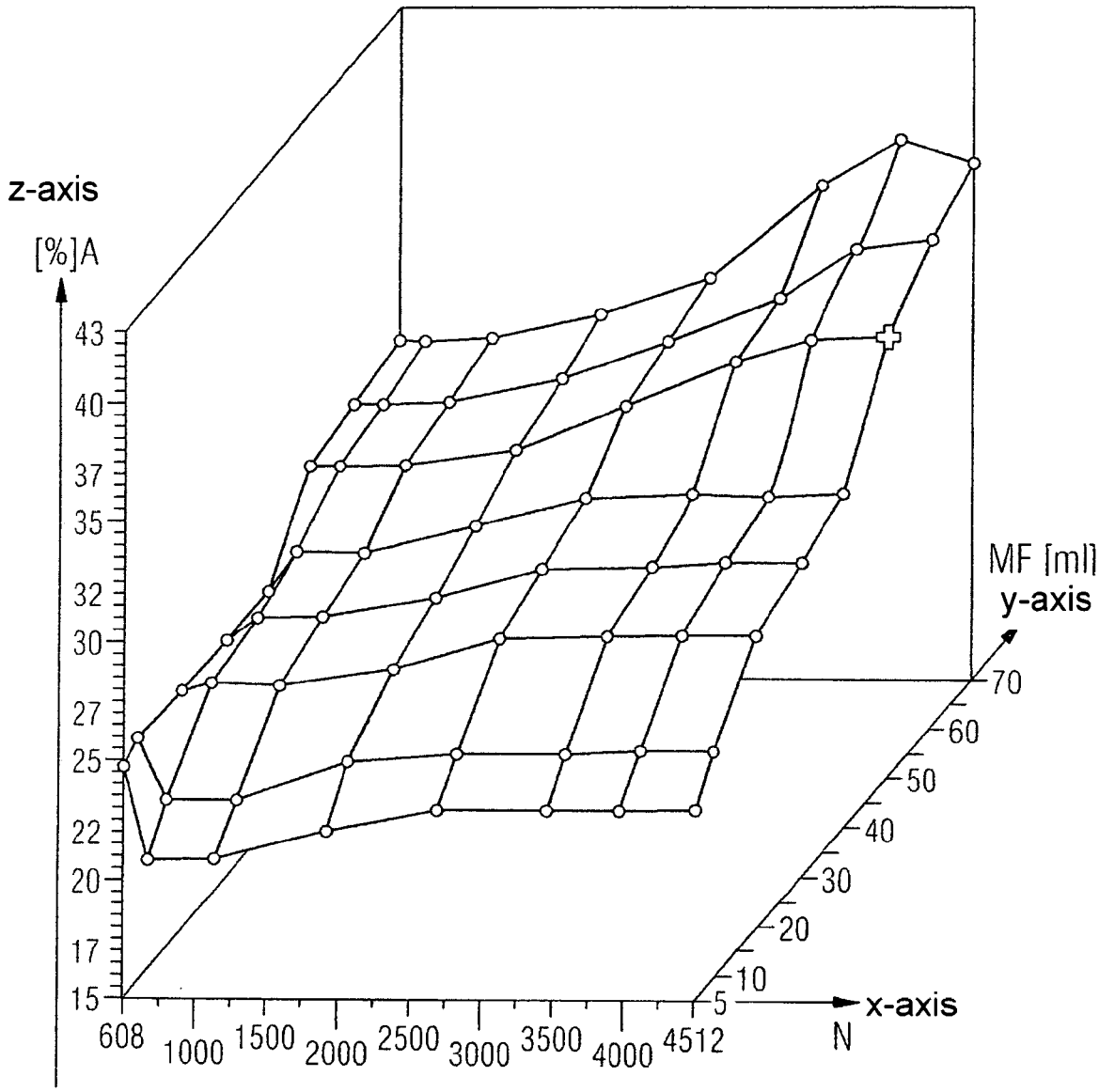
FIG. 3 is a graph of a two-dimensional adaptation characteristic field of an exemplary embodiment of the invention.

FIG. 3 shows an exemplary embodiment of the adaptation characteristic field according to the invention. The operating parameters used therein are the mass of fuel MF and the engine speed N. Thus, in this special case, the adaptation characteristic field has the same axes as the precontrol characteristic field in FIG. 2. The x-axis shows the speed N and the y-axis the mass of fuel MF. The adaptation value A can be read on the z-axis as a percentage value of a maximum angle of opening of the volumetric flow control valve VCV.

In an alternative embodiment of the invention, provision is made for the adaptation values to be stored in the adaptation characteristic field as a function of two of the following respective operating parameters: mass of fuel MF, engine torque, engine speed N and/or load TQI. With two of these respective parameters, the two-dimensional adaptation characteristic field can be used to assign the adaptation value precisely to the load of the internal combustion engine. This prevents an incorrect angle of opening of the volumetric flow control valve VCV causing the high pressure pump to supply too much or too little fuel to the fuel tank of the internal combustion engine. The control according to the invention advantageously compensates for manufacturing tolerances in the individual components of the injection system in the internal combustion engine.

In order to determine the adaptation values, provision is also made for the values of the adaptation characteristic field to preferably be interpolated in a linear manner. As a result, intermediate values can also be determined with a simple linear regression so that the adaptation values can be determined more precisely.

Provision is also made according to the invention for the adaptation values for the individual load points to be continuously adjusted in the two-dimensional adaptation characteristic field, so that automatic adaptation results for the volumetric flow control valve VCV. This results in precise load-point-dependent adjustment to the components used which are subject to tolerances. That adjustment is independent of their age and wear.

In order to adapt the adaptation values of the adaptation characteristic field, the control variable of the PI controller of the pressure control valve is monitored by a control unit. If the control variable of the PI controller exceeds a defined threshold, the control unit inputs a corresponding adaptation value into the adaptation characteristic field at the present operating point according to the parameters of the axis of the adaptation characteristic field. The adaptation value is selected in such a way that when the volumetric flow control valve VCV is activated with the precontrol value from the precontrol characteristic field and the adaptation value from the adaptation characteristic field, so much fuel is supplied to the fuel tank that the control variable of the PI controller falls back below the threshold. The adaptation value is, for example, reduced or increased by a defined value or a defined percentage when the regulator value exceeds or drops below the threshold.

Optimal adjustment to the required mass of fuel ensures that the low pressure system is not sensitive to heat input through the fuel return system. The return system can therefore be connected in proximity or directly to the high pressure pump, since the fuel is no longer heated.

A further advantage is deemed to be that regulation quality is improved particularly with injection methods having multiple injections, since the pressure fluctuations in the rail due to an incorrect or non-stable valve position are minimized.

Figure 4:
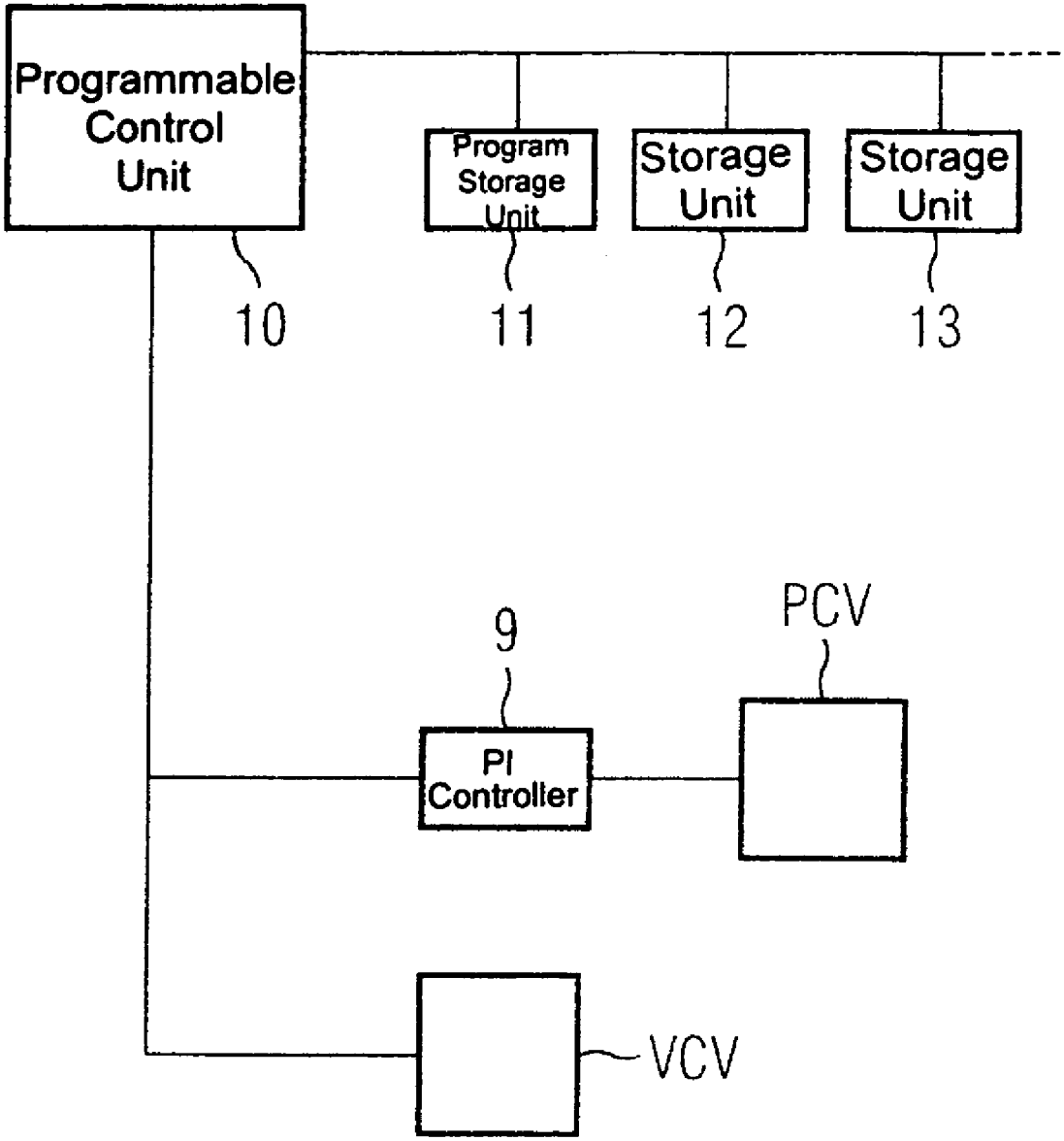
FIG. 4 is a block circuit diagram of a device according to the invention.

FIG. 4 shows an exemplary embodiment of the invention with a device for controlling the load-point-dependent volumetric flow in a common rail injection system. The device has a programmable control unit 10, which is connected to a program storage unit 11, a storage unit 12 for a first precontrol characteristic field for the pressure control valve and a second precontrol characteristic field for the volumetric flow control valve, and a storage unit 13 for an adaptation characteristic field. The control unit 10 runs a program, which regulates or controls the following connected components: fuel pre-delivery pump 1, high pressure pump 8, high pressure control valve PCV and volumetric flow control valve VCV. Provision is made for a PI controller 9 to regulate the high pressure control valve PCV according to the predefined first precontrol characteristic field. The PI controller 9 is also connected to the control device 10 and reports the current regulation value of the high pressure control valve to the control device 10. The control device 10 is connected to sensors, which detect the operating parameters, in particular the speed, mass of fuel, engine torque and load. The valve position of the volumetric flow control valve VCV is controlled by using the second precontrol characteristic field and the two-dimensional adaptation characteristic field in such a way that the required quantity of fuel is supplied at each current load point as precisely as possible. This load-point-dependent control of the volumetric flow control valve VCV advantageously means that the quantity of fuel returned is minimized and the fuel in the tank does not therefore heat up. It also means that the high pressure pump, which is driven with a toothed belt or a mechanical coupling, absorbs less energy and the power consumption of the high pressure pump is thereby reduced. This results in greater engine power and/or lower fuel consumption.

This application claims the priority, under 35 U.S.C. § 119, of German patent application No. 10 2004 009 616.3, filed Feb. 27, 2004; the entire disclosure of the prior application is herewith incorporated by reference.

We claim:

1. A method for controlling a volumetric flow in a common rail injection system of an internal combustion engine, which comprises the following steps:

producing a rail pressure with a high pressure pump;

setting the rail pressure in the rail with a regulatable high pressure control valve; and determining the volumetric flow by a valve position of a controllable volumetric flow control valve controlled by a precontrol characteristic field and a two-dimensional adaptation characteristic field having adaptation values for the valve position being predefined as a function of two operating parameters of the internal combustion engine.

2. The method according to claim 1, which further comprises determining the adaptation values for the valve position in the adaptation characteristic field as a function of two of the following respective operating parameters:

mass of fuel, engine speed, engine torque, and load.

3. The method according to claim 1, which further comprises storing the adaptation values in the adaptation characteristic field using engine speed and mass of fuel as the operating parameters.

4. The method according to claim 3, wherein the adaptation characteristic field and the precontrol characteristic field have the same parameter axes.

5. The method according to claim 1, which further comprises interpolating a current adaptation value from adjacent values of the adaptation characteristic field.

6. The method according to claim 5, wherein the interpolation is linear.

7. The method according to claim 1, which further comprises adjusting the adaptation values of the adaptation characteristic field as a function of a regulation value of a regulator of the high pressure control valve.

8. A device for controlling a load-point-dependent volumetric flow in a common rail injection system of an internal combustion engine, the device comprising:

a high pressure pump;

a regulatable high pressure control valve connected to said high pressure pump;

a controllable volumetric flow control valve connected to said high pressure pump;

a storage unit storing a two-dimensional adaptation characteristic field for said volumetric flow control valve; and a programmable control unit connected to said storage unit, to said high pressure control valve and to said volumetric flow control valve, said programmable control unit controlling a valve position of said volumetric flow control valve as a function of a precontrol characteristic field and the adaptation characteristic field as a function of two operating parameters of the internal combustion engine.

9. The device according to claim 8, wherein the adaptation values are stored in the adaptation characteristic field as a function of a speed of the internal combustion engine and a mass of fuel.

10. The device according to claim 8, which further comprises a regulator connected to said high pressure control valve, said control unit detecting a regulation value of said regulator and reducing or increasing the adaptation value in the adaptation characteristic field, if the regulation value exceeds or is below comparison thresholds.

* * * * *